United States Patent [19]

Dauphinais

[11] Patent Number: 4,619,474

[45] Date of Patent: Oct. 28, 1986

[54] ASH-REMOVAL SHOVEL

[76] Inventor: Paul Yvan Dauphinais, 3625 Pacific Street, Saint-Hubert, Canada, J3Y 5K2

[21] Appl. No.: 776,909

[22] Filed: Sep. 17, 1985

[51] Int. Cl.[4] ..... A47F 13/08

[52] U.S. Cl. ..... 294/9; 294/55

[58] Field of Search ..... 294/9, 55, 10, 50.9, 294/53.5, 49, 50.8, 1.1, 19.1; 15/257.1, 257.2, 257.5, 257.6; 126/244, 243, 242; 220/2, 260, 262, 263

[56] References Cited

U.S. PATENT DOCUMENTS

| | | | |
|---|---|---|---|
| 1,762,347 | 6/1930 | Peebles | 294/55 |
| 2,315,831 | 4/1943 | Wilcox | 294/55 |
| 4,037,867 | 7/1977 | Fano et al. | 294/55 |
| 4,299,419 | 11/1981 | Kalan | 294/9 |
| 4,457,548 | 7/1984 | Robin et al. | 294/9 |

*Primary Examiner*—James B. Marbert

[57] ABSTRACT

There is disclosed a shovelling device for removing ashes from an ash-pit. The shovel comprises a box-like casing, including top and bottom walls, two side walls, a rear wall, and a front flap door hingedly secured to the top wall. A handle projects outwardly from the rear wall of the casing. A closure member is mounted on the outer face of the casing top wall, so as to releasably close by the outside the casing flap door.

5 Claims, 6 Drawing Figures

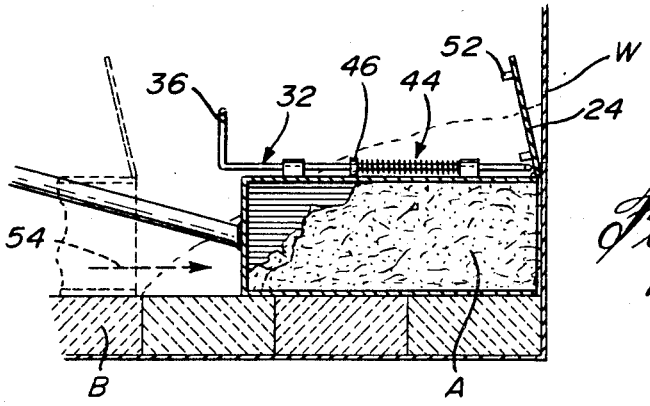
Fig. 4
Fig. 5
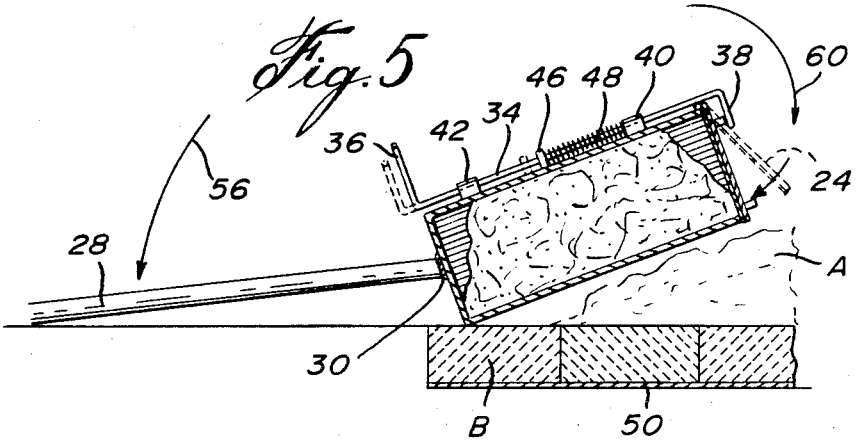
Fig. 6
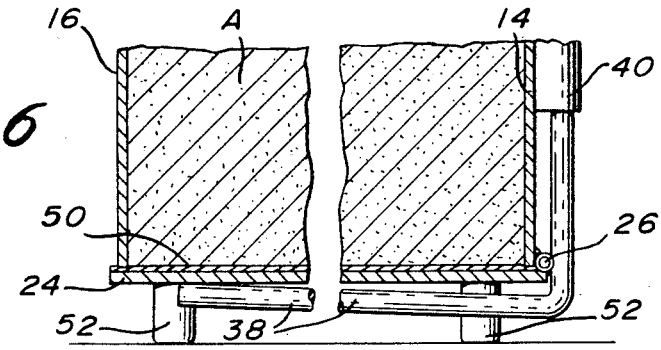

ASH-REMOVAL SHOVEL

FIELD OF THE INVENTION

This invention relates to shovels.

BACKGROUND OF THE INVENTION

In the Canadian Pat. No. 115,334, issued Nov. 10, 1908 to Clement and Vogue, there is disclosed a closed ash scoop having the general goal of removing ashes from a stove in a dust-free manner. This scoop is closable by the engagement of the door wings 16 thereinto and, thus, the pivoting of downwardly-hinged door 8 under the action of an inner rod 10 (FIGS. 1 and 2). Rod 10 is actuated by the vertical swinging movement of the outwardly-projecting frame 12 and handle 13 which rotates the shaft 7, which moves fore and aft the crank arm 9, to which is connected rod 10.

Major drawbacks appear in the above patent to the knowledgeable person.

Since rod 10, crank arm 9, shaft 7, and wings 16 are all movable parts within the scoop, it can be expected that their operation will become less and less efficient with time, because of ashes that will progressively clog same. It is not a good principle to have the closing mechanism of the scoop door within the scoop. The same problem will occur at the level of the bottom hinges of door 8, since ashes will progressively clog same and prevent pivoting of the door. Furthermore, ashes will find their way through this hinge member, as well as through the apertures 3A through which the outer frame 12 connects with the shaft 7. And because one needs to swing handle 13 above the scoop casing 1 to close the door 8, closing that door inside the ash-pit is not possible, thereby constituting a dirty operation, since that has to be done after removing the open scoop from the stove.

In the Canadian Pat. No. 211,532, issued May 17, 1921 to Gehrmann, the ash-pan is designed to fit permanently in the stove for collection of ashes, and be removable when full. The rod 11 of the ash-pan will operate a top cover 12, 13, not a side door. Apparently, ashes could engage the pan through hinged ends 3 and 4, but these have to be operated by hand. In any event, collecting ashes into and removing same from the ash-pan remains a dirty operation. Rod 11 still is within the ash-pan, thus clog-prone.

The U.S. Pat. No. 2,800,892, issued July 30, 1957 to Gontaro, refers to a receptacle to fit in an incinerator to collect ashes, as in Gehrmann, not to a shovel. The cover 13 and hinged plate 25 are both on the top wall of the receptacle.

OBJECT OF THE INVENTION

The object of this invention is to provide a shovel adapted to remove ashes from an ash-pit in a dust-free manner.

SUMMARY OF THE INVENTION

Accordingly with the object of the invention, there is disclosed a shovelling device for removing ashes from an ash-pit. This shovel comprises a box-like casing including top and bottom walls, two side walls, a rear wall, and a front flap door hingedly secured to said top wall. A handle outwardly projects from said rear wall. A closure member is mounted on the outer face of the said top wall to releasably close by the outside said casing flap door.

Preferably, said closure member consists of a rod, including an intermediate portion and front and rear bent end portions, and at least two longitudinally-spaced front and rear brackets fixedly secured to the outer face of said top wall and through which slidingly and rotatively engages said rod main portion. The rod rear end portion constitutes an operating lever and the rod front end portion constitutes a closure lever, the latter in its downwardly-oriented position being releasably positionable against the downwardly-pivoted flap door to close same.

Advantageously, said rod and said handle are in longitudinal registry. Profitably, the axes of said operating and closure levers are at least at right angle from each other and, preferably at about 135 degrees from each other.

Biasing means can be provided to bias said closure member to close said flap door. This preferably comprises a ring, fixedly secured to an intermediate section of said rod main portion, and a coil spring surrounding the latter and extending in between said ring and said front bracket. Pushing said rod forwardly is against the bias of said coil spring, since said ring pushes said spring against said front bracket, said closure lever in its downwardly-directed position, being thereby biased against said flap door to sealingly close said casing.

An asbestos sealing strip could be applied against the inner face of said flap door. And at least two pairs of small projections could be fixedly spacedly secured on the outer face of said flap door and be adapted to support said device over the ground upon upright positioning of the casing.

BRIEF DESCRIPTION OF THE DRAWINGS

FIG. 4 is a similar longitudinal section, showing how the ashes are collected in the ash-pit;

FIG. 5 is the view of FIG. 4 but without the back wall of the ash-pit and said shovel being pulled out therefrom; and FIG. 6 is an enlarged view of the lower part of the shovel in the position of FIG. 3.

DETAILED DESCRIPTION OF THE PREFERRED EMBODIMENT OF THE INVENTION

Figure 1:
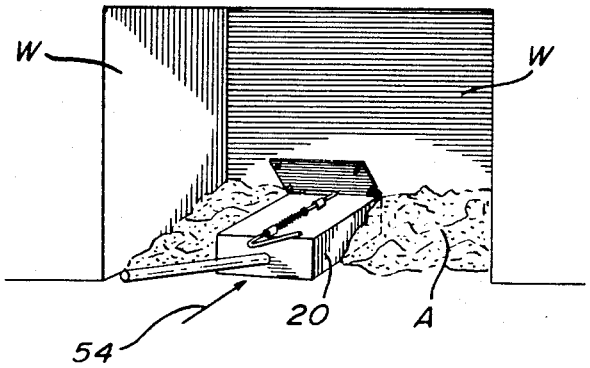
FIG. 1 is a downwardly-rearwardly-looking perspective view of an ash-removing shovel according to the invention, shown as being positioned within the ashes of an ash-pit.

The present invention is embodied in a device 10 consisting of a box-like casing 12 adapted to receive and temporarily store ashes A. Casing 12 includes top and bottom walls 14, 16, side walls 18 and 20, a rear wall 22, and a front flap door 24 (larger than rear wall 22) hingedly secured to the top wall 14 by hinge member 26 (see FIG. 6).

A handle-bar 28 is secured to the rear wall 22, as by spot-welding 30, and projects upwardly rearwardly therefrom, as is clear from FIG. 1, so as to facilitate handling thereof by an operator.

A rod 32 is also provided in device 10. Rod 32 defines a main portion 34, a rear end portion 36, bent at right angle therefrom, and a front end portion 38 bent at right angle from the main portion and at at least 90° and preferably about 135° from the axis of the said front end portion.

From top wall 14 upwardly project two longitudinally-spaced front and rear sleeved brackets 40, 42, in longitudinal registry with the handle-bar 28, and slidingly rotatively receiving the rod main portion 34 therethrough.

The rod main portion 34 is slightly longer than the top wall 14 of the casing, so that the rod front end portion 38 be releasably pivotable in front of and against the door 24, as a closure lever. Consequently, the rod rear end portion 36 is also pivotable, and is manually handled by an operator as a hand lever to facilitate pivotal of the closure lever 38.

The reason for the 135-degree difference in the axes of levers 36 and 38 is to further facilitate handling of the hand lever 36, to prevent the knuckles of the operator's hand to strike the rear edge 14A of top wall 14. With this consideration in mind, the distance between hand lever 36 and the rear edge 14A should be at all times sufficiently large to prevent such a non-desirable event to occur, for the comfort of the operator.

Biasing means 44 should be provided to normally maintain the closure lever 38 forcibly releasably applied against the flap door 24, so that the latter releasably sealingly closes the casing 12. Biasing means 44 includes a ring 46, welded to an intermediate section of the rod main portion 34, and a compression coil spring 48 surrounding the latter and extending between the ring and the front bracket 40.

Consequently, the forward sliding of rod 32 through brackets 40, 42 is made against the bias of coil spring 48, since ring 46 presses the coil spring against the front bracket 40. When hand lever 36 is rotated and closure lever 38 is pivoted in front of door 24, rod 32 is then released and the closure lever 38 forcibly applies against the flap door.

It would be advantageous to provide the inner face of the flap door 24 with an asbestos sealing strip 50, so that it will not be damaged by hot ashes.

Preferably, shock-absorbing means are provided to dampen the shock caused by door 24 upon closing. Such means can be a coiled spring fixed to one side wall and forwardly projecting from the front opening of the casing 12 just sufficiently to contact the door at the terminal portion of its closing travel. A spring-loaded steel cable, attached to the top wall and to the door on the outside thereof, could achieve the same purpose.

Figure 3:
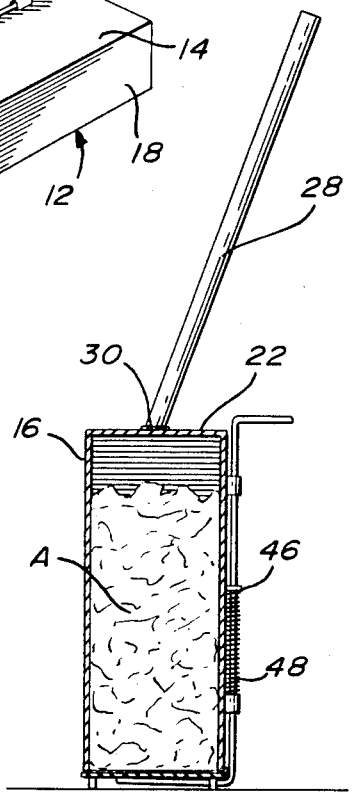
FIG. 3 is a longitudinal section of said shovel shown standing on the feet of its closed door.

It would also be advantageous to provide four small projections or feet 52, at the four corners of the outer face of the flap door 24, made of an insulating material, preferably elastomeric, the idea being not to burn the house carpet when the casing 12 stands thereon, as illustrated in FIG. 3.

Figure 2:
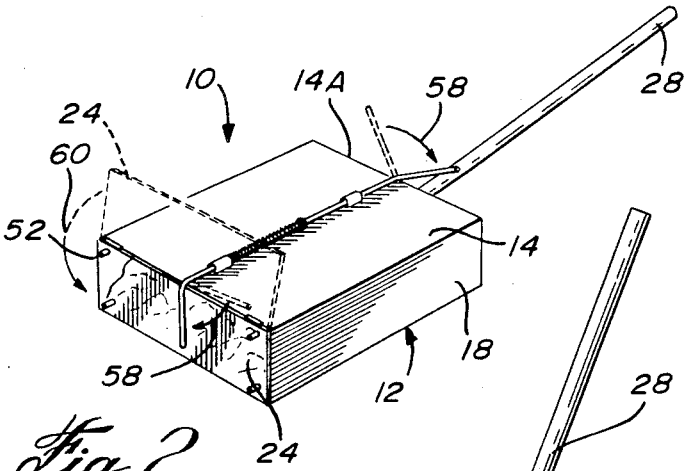
FIG. 2 is a downwardly-forwardly-looking perspective view of said shovel and further showing its door in open position in phantom lines.

With this device, the stated goal is met, to wit, prevent dust formation within the house when filling the casing 12 of the shovel device 10 with ashes A by pushing same into these ashes A (arrow 54) over a layer of bricks B or other (FIG. 4) with the door 24 having been previously opened, abutting against the ash-pit wall W the front end of the casing, pulling outwardly downwardly handle 28 (arrow 56), and pushing and rotating rod 32 (arrow 58) from its position in dotted lines in FIG. 5 to its position in full lines, so that the flap door be closed (arrows 60 in FIGS. 2 and 5).

Note is to be taken of the fact that the wall W of the ash-pit must be more than twice as high as the height of the flap door 24, so that the latter be freely pivotable. The shovel can be dimensioned to be operable in wood- or coal-burning stoves as well as in fire-places.

What I claim is:

1. A shovelling device for removing substantially all ashes from an ash-pit, comprising a box-like casing including top and bottom walls, two side walls, a rear wall, and a front flap door hingedly secured to said top wall; a handle bar outwardly projecting from said rear wall; a closure member, mounted on the outer face of the said top wall to releasably close by the outside said casing flap door, and consisting of a rod, including an intermediate portion and front and rear bent end portions, and at least two longitudinally-spaced front and rear brackets fixedly secured to the outer face of said top wall and through which slidingly and rotatively engages said rod main portion; said rod rear end portion constituting a hand-actuated operating lever and said rod front end portion constituting a closure lever, the latter in its downwardly-oriented position being releasably positionable against the flap door to close same; a ring, fixedly secured to an intermediate section of said rod main portion; and a compression coil spring surrounding the rod intermediate section and extending in between said ring and said front bracket; whereby pushing said rod forwardly compresses said coil spring, by pushing said coil spring against said front bracket, said closure lever in its flap closing position being biased against said flap door by said coil spring to sealingly close said casing.

2. The shovelling device as defined in claim 1, further including at least two pairs of small identical projections fixedly spacedly secured on the outer face of said flap door, cylindrical in shape, having flat outer faces and made of an insulating material, and adapted to support said device upright on the ground to cooperate with said closure lever when in its flap door closing position for sealingly closing the flap door.

3. The shovelling device as defined in claim 2, wherein said small projections are made of an elastomeric material.

4. The shovelling device as defined in claim 2, wherein, in its flap closing position, said closure lever extends in between said projections, the thickness of said closure lever being smaller than the length of said projections.

5. A shovelling device for particulate matter, consisting of a casing defining a main rigid hollow body having a front flat mouth, a front flat lid larger than and releasably closing said front mouth, pivot means for pivotally mounting said lid to the main body for outward pivotal thereabout, a handle rod rearwardly projecting from the rear of said body, spaced small cylindrical feet of same length and with flat outer faces and fixed to the outer face of said flat lid, a frame member mounted to the exterior of said main body and including a front closure lever adapted to releasably closingly register with said flat lid in a closing position, and biasing means rearwardly biasing said closure lever, said lid feet adapted to support said device over ground in a ground-standing position; the weight of the device loaded with particulate matter, together with said biasing means biasing said closure lever in its closing position against said lid, cooperating in completely sealingly closing said casing to prevent any outward seeping of particulate matter when in said ground-standing position.

* * * * *